US005986244A

United States Patent [19]

Jonsson et al.

[11] Patent Number: 5,986,244

[45] Date of Patent: Nov. 16, 1999

[54] METALLIC HIGH TEMPERATURE RESISTANT MATERIAL AND A METHOD OF PRODUCING IT

[75] Inventors: Bo Jonsson, Vasteras; Gunnar Landor, Hallstahammar, both of Sweden

[73] Assignee: Kanthal AB, Hallstahammer, Sweden

[21] Appl. No.: 09/017,493

[22] Filed: Feb. 2, 1998

Related U.S. Application Data

[63] Continuation of application No. PCT/SE96/00998, Aug. 8, 1996.

[30] Foreign Application Priority Data

Aug. 11, 1995 [SE] Sweden ..... 9502807

[51] Int. Cl.[6] ..... H05B 3/10

[52] U.S. Cl. ..... 219/553

[58] Field of Search ..... 219/553, 548, 219/544, 505; 392/407, 408; 338/230, 238, 245; 420/62; 252/500; 21/617

[56] References Cited

PUBLICATIONS

002499260 WPI Acc No: 80–17275C/10 XRAM Acc No: C80–C17275 JP 55/010741 Jan. 1980 Abstract.

002254622 WPI Acc No: 79–53822B.29 XRAM Acc No: C79–B53822 JP 48/009918 Feb. 1973 Abstract.

*Primary Examiner*—Teresa Walberg
*Assistant Examiner*—Vinod D Patel
*Attorney, Agent, or Firm*—Pillsbury Madison & Sutro LLP

[57] ABSTRACT

The heat in an electrical heating wire is transferred by way of radiation, or conduction, or convection. Especially in the case of highly rated elements operating in air, where the temperature of the environment is relatively cold, heat transfer by radiation is predominant. In order to achieve as low element temperature as possible at a given surface loading, it is desirable to raise the emissivity coefficient. The surface coating on an element of which the base material is an alloy containing 10–30 weight % Cr, 2–10 weight % Al, maximum 5 weight % of other alloying elements and balance Fe, according to the present invention consists of metal, metal alloy, metal compound or metal oxide with an emissivity coefficient which is higher than that of aluminium oxide. Different metals could be considered for the surface coating, most suited are nickel, cobalt, chromium and iron. In addition to the increase of the emissivity coefficient also other advantages are achieved, for example improved deformation stability at operating temperature.

8 Claims, 1 Drawing Sheet

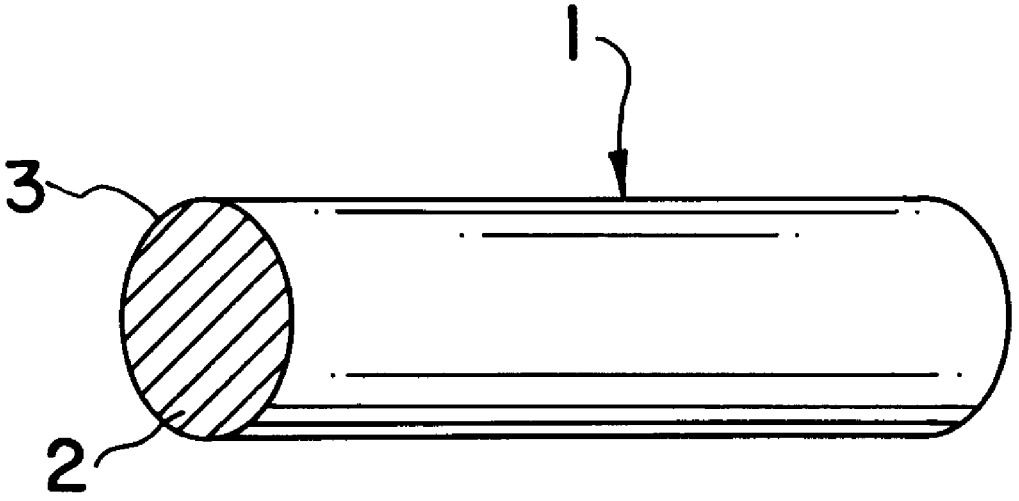
1
3
2

METALLIC HIGH TEMPERATURE RESISTANT MATERIAL AND A METHOD OF PRODUCING IT

This application is a continuation of PCT/SE96/00998 filed Aug. 8, 1996.

BACKGROUND OF THE INVENTION

The heat in an electric heating wire is transferred by radiation, conduction and convection. Especially from highly rated elements operating in air, if the environment is relatively cold, heat transfer by radiation is predominant. If radiation is the only means of transfer, Stefan Bolzman's law applies. Under certain assumptions it can be written as follows:

$$p=\epsilon\cdot\sigma\cdot(Te^4-Ts^4)$$

where $\sigma$=5,670×10−8[$W/m^2K$]

$p$=surface rating [$W/m^2$]

$Te$=element temperature $Ts$=temperature of the environment $\epsilon$=emissivity coefficient of the surface of the heating element (can have any value between 0 and 1)

This equation shows that for a certain surface rating (Te−Ts) reaches its lowest value when $\epsilon$ has its largest value, i.e.=1. In this case the surface is said to be radiating as a "perfectly black body". For ordinary materials $\epsilon$ varies from values which are as low as 0.005 for a bright metal surface, up to 0.9 for certain materials which also have a appropriate surface roughness. In order to achieve as low as possible element temperature at a predetermined surface rating, it will therefore be necessary to raise the emissivity coefficient of the material.

SUMMARY OF THE INVENTION

The present invention refers to alloys of FeCrAl-type, which contain 10–30 weight-% Cr, 2–10 weight-% Al, maximum 5 weight-% of other alloying additions and balance Fe. At temperatures above approximately 950° C. a layer of relatively pure $Al_2O_3$ is formed on the surface of the material in oxidizing atmospheres. Such a fully oxidized surface with time obtains an emissivity coefficient of about 0.7, somewhat dependent upon the topology of the surface etc. As, in many cases, the life of an element is determined by the velocity of the heavily temperature dependent oxidation process, it is evident that an increase of the emissivity from 0.7 to for instance 0.9 will have a considerable influence on the element life. The following table will exemplify this fact.

| Surface rating (W/cm2) | Emissivity $\epsilon$ | Temperature (° C.)* | Element life (% increase) |
|---|---|---|---|
| 7 | 0.7 | 880 | 100 |
| 7 | 0.9 | 810 | 719 |

-continued

| Surface rating (W/cm2) | Emissivity $\epsilon$ | Temperature (° C.)* | Element life (% increase) |
|---|---|---|---|
| 10 | 0.7 | 987 | 100 |
| 10 | 0.9 | 911 | 601 |

*The temperature is calculated based on an environment temperature of 25° C. and freely radiating heating elements.

It should be pointed out that also small increases in the emissivity coefficient which might be achieved by suitable surface topology could be of interest in practical work. The life of a resistance wire having a certain microscopical surface roughness, has increased by 20 to 100%, dependant upon application, by increasing the emissivity.

It is a well-known fact that different ceramic surface coatings on heating elements and/or furnace walls could increase the emissivity, which in turn has been noticed to give a higher rating and a faster heat up time of the furnace load. For this reason thermal spraying has been employed in order to apply different types of oxides, such as calcium oxide, magnesium oxide etc. Concerning smaller dimensions and mass produced heaters, which is the category that the present invention is directed towards, the additional costs resulting from the coating of finished-components will be difficult to justify.

By adding alloying elements such as cobalt, vanadium and copper it has been the aim to attain a 'product' on which surface an oxide with high emissivity develops. These known methods have drawbacks of different kinds, partly from a cost stand point and partly from a technical stand point. Of importance in this connection are the possibilities of further processing the product, for example by rolling or by wire drawing. The product which is to be further processed should have a surface layer with very good adhesion and such properties which do not cause undue wear on the equipment used for processing.

BRIEF DESCRIPTION OF THE DRAWING

The FIGURE illustrates a heating element wire.

DETAILED DESCRIPTION OF THE INVENTION

The surface coating of a heating element 1 according to the present invention is a metal or an alloy on which the oxide has higher emission coefficient than aluminium oxide, or alternatively, metal alloys which can be oxidized producing an oxide with higher emissivity coefficient than aluminium oxide. Different metals could be considered for the surface coating according to the invention. The most suitable ones are nickel, cobalt, chromium and iron or an alloy of one or several of these metals and the base metal. In addition to the increase of the emissivity coefficient also other advantages, as shown in the following examples, will be achieved.

A thin layer of cobalt oxide on the outermost surface 3 of a product of a FeCrAl alloy 2, (wire, strip, sheet, etc.) has turned out to have a very high emissivity coefficient and a decrease in temperature in the order of 50° C. Experiments have shown that cobalt oxide does not affect the growth of the $Al_2O_3$ layer, which forms spontaneously at high temperature. The growth of the $Al_2O_3$ layer is basically taking place at the interface $Al_2O_3$ metal, and the solubility of Co/CoO in $Al_2O_3$ is negligible. Accordingly a cobalt oxide layer, which is present on the surface at the start is also located on the surface after long time and is reasonably unaffected.

Different methods have been tested to produce such a layer in practice. Even if a surface layer of cobalt oxide is desirable, also a surface layer of metallical cobalt or other cobalt alloys could be applied, provided that it becomes oxidized when the wire reaches the operating temperature. A vacuum deposited layer of Co on a finished wire 0 0.7 mm has been tested and found to be useful. A compound of $CoNO_3$ has been applied to a finished wire 0 0.7 mm. Also this is possible to use as the compound oxidizes rapidly to cobalt oxide.

Also a surface coating containing nickel will operate satisfactorily and two important improvements are achieved using such a surface coating:

i) The emissivity increases when the surface layer is oxidized to NiO, which in turn leads to a decrease in temperature of the radiating element.

ii) The strength of the element increases as a result of the formation of a diffusion zone within the surface layer where Ni partly is dissolved and partly forms precipitations of more or less continuous areas which basically contain Ni aluminide, which increases the hot strength and the deformation resistance of the elements. It is quite evident that the influence of a relatively thin surface layer of increased strength, on the deformation resistance, is largest, when the total cross section of the element is relatively small. A surface zone underneath and adjacent to the surface layer could also constitute the area of increased strength.

Similar effects could also be expected using other metals than nickel. The improved strength makes the materials more suited also for other applications, where the increased emissivity is of less significance, but the improved strength is of importance.

An experiment has been performed where Ni layers of different thicknesses have been applied electrolytically to a coil made of 0 0,4 mm FeCrAl wire. After the surface coating process, some of the samples have been subject to a diffusion treatment in vacuum, in order to form a diffusion zone. Depending upon the original thickness of the Ni layer, this has resulted in a remaining portion of pure Ni on the surface varying in thickness from zero to several $\mu$m.

At subsequent use of the elements, basically pure $Al_2O_3$ was formed on the specimens in which the Al content on the surface had reached a sufficiently high level, while at the same time a surface oxide containing essentially NiO formed on the other coated samples including the ones which had not been diffusion treated. An improved deformation resistance and a decrease in temperature resulted in the specimens where the Ni layer had been of sufficient thickness. In practice the parameters could be varied in such a way that the temperature decrease and improvement in deformation resistance could be matched to best suit the application.

The adherence of the surface layer to the substrate is of importance. If a layer of aluminium oxide is formed underneath the surface layer, this could improve the adherence between the outermost surface layer and the substrate, and also form a diffusion barrier for metal from the surface layer into the substrate.

Surface coating of finished material in industrial scale presents certain difficulties. In stead, surface coating could be done on semi finished products, for example hot rolled and pickled rod. The surface layer is maintained during dry and wet drawing to finished size, but decreases in size. The original coating thickness must be adjusted accordingly.

Certain products according to the invention are also more simple to shape and causes less wear on the tools than an uncoated product, as for instance, cobalt or alternatively cobalt oxide is less abrasive than $Al_2O_3$, which is present on a conventional product, even if the layer thickness of $Al_2O_3$ normally is extremely thin.

We claim:

1. Metallic, high temperature resistant material, of which the base material is an alloy containing 10–30 weight-% Cr, 2–10 weight-% Al, maximum 5 weight-% of other alloying elements and balance Fe, wherein a surface layer which basically consists of one of a metal, metal alloy and metal compound, which after oxidation has an emissivity coefficient which is higher than that of one of aluminium oxide and a metal oxide which has a higher emissivity coefficient than aluminium oxide.

2. Metallic electrical resistance material or element in the shape of wire, strip, sheet or rod, of which the base material is an alloy containing 10–30 weight-% Cr, 2–10 weight-% Al, maximum 5 weight-% of other alloying elements and balance Fe, wherein a surface layer which basically consists of one of metal, metal alloy and metal compound, which after oxidation has an emissivity coefficient which is higher than that of one of aluminium oxide and a metal oxide which has a higher emissivity coefficient than aluminium oxide.

3. Material or element according to claim 1 wherein one of that the surface layer consists of a metal oxide which is formed spontaneously on the corresponding metal or metal alloy at the operating temperature of the element.

4. Material or element according to any of the preceding claims wherein one of that the metal, the metal alloy or the metal oxide is nickel, cobalt, chromium or iron or a compound or an oxide thereof, or a mixture of two or more of these elements, or a mixture of one or several of these elements with the base material.

5. Material or element according to claim 1 of the preceding claims characterized in wherein one of the surface layer and the surface zone has a higher hot strength than the base material.

6. Material or element according to claim 1 of the preceding claims characterized in wherein the thickness of the surface layer is <20 $\mu$m, preferably <10 $\mu$m.

7. Method of producing a metallic electrical resistance material of a FeCrAl alloy with a surface layer of metal, metal alloy or metal compound, wherein that the material is coated with a metal compound which during heating is transformed into metal or metal oxide.

8. Method of producing a metallic electrical resistance material of a FeCrAl alloy with a surface layer of metal, metal alloy or metal compound, wherein that a coating with a layer thickness >10 $\mu$m is put on a material, which cross section area substantially exceeds the cross section area of the finished product, after which the material by drawing, rolling or other means is reduced to desired cross section area and a surface layer thickness of <10 $\mu$m.

* * * * *